United States Patent [19]

Nakamoto et al.

[11] Patent Number: 4,809,664

[45] Date of Patent: Mar. 7, 1989

[54] FUEL CONTROLLING SYSTEM FOR INTERNAL COMBUSTION ENGINE

[75] Inventors: Katsuya Nakamoto; Yoshiaki Kanno; Ryoji Nishiyama, all of Hyogo, Japan

[73] Assignee: Mitsubishi Denki Kabushiki Kaisha, Tokyo, Japan

[21] Appl. No.: 137,581

[22] Filed: Dec. 24, 1987

[30] Foreign Application Priority Data

Dec. 26, 1986 [JP] Japan ..... 61-314212

[51] Int. Cl.[4] ..... F02D 41/14; F02D 41/04

[52] U.S. Cl. ..... 123/436; 123/425; 123/419; 123/435

[58] Field of Search ..... 123/436, 435, 425, 419

[56] References Cited

U.S. PATENT DOCUMENTS

| | | | |
|---|---|---|---|
| 4,660,535 | 4/1987 | Asano | 123/435 |
| 4,683,856 | 8/1987 | Matsuura et al. | 123/436 |
| 4,697,561 | 10/1987 | Citron | 123/436 |
| 4,736,724 | 4/1988 | Hamburg et al. | 123/436 |

FOREIGN PATENT DOCUMENTS 57-88242 6/1982 Japan .

*Primary Examiner*—Raymond A. Nelli

*Attorney, Agent, or Firm*—Bernard, Rothwell & Brown

[57] ABSTRACT

A fuel controlling system for an internal combustion engine, e.g. a vehicular engine, provided for ensuring an appropriate air fuel ratio and a stable rotational output independently of variations in the quantity of air introduced into the engine.

6 Claims, 11 Drawing Sheets

FUEL CONTROLLING SYSTEM FOR INTERNAL COMBUSTION ENGINE

BACKGROUND OF THE INVENTION

1. Field of the Invention

The present invention relates to a fuel controlling system for an internal combustion engine in which the quantity of intake air in the internal combustion engine is detected by an air flow sensor and the quantity of fuel to be fed to the internal combustion engine is controlled on the basis of the detected output.

2. Description of the Prior Art

According to a conventional method of controlling the quantity of fuel to be fed to an internal combustion engine, an air flow sensor (hereinafter referred to simply as an "AFS") is disposed upstream of a throttle valve and the quantity of intake air per intake is determined on the basis of information obtained by the AFS and the engine speed to control the quantity of fuel to be fed.

In the case where an AFS is disposed upstream of the throttle valve in the air intake passage to detect the quantity of intake air for an internal combustion engine, when the throttle valve opens suddenly, the quantity of air charged into the intake passage between the throttle valve and the engine is also measured, so the total quantity of air measured will be larger than that actually introduced into the internal combustion engine, resulting in that the fuel quantity control based on such measured quantity would cause an overrich condition. According to a conventional proposal for avoiding this inconvenience, if the output of the AFS, i.e., a detected intake air quantity at a predetermined crank angle, is an $AN_{(t)}$, the quantity of air introduced into the internal combustion engine at $n-1^{th}$ time and that at $n^{th}$ time both of the predetermined angle are $AN_{(n-1)}$ and $AN_{(n)}$, respectively, and the filter constant is K, $AN_{(n)}$ is calculated according to the following equation and fuel control is made using the calculated $AN_{(n)}$:

$$AN_{(n)}=K_1\times AN_{(n-1)}+K_2\times AN_{(t)}$$

This is for smoothing the intake air quantity at every predetermined crank angle to effect an appropriate fuel control.

According to the above conventional fuel control system, however, a relatively large amount of time is required for the calculation of the air quantity, so in the event of variation in the number of revolutions caused by disturbance such as a change of the road surface, for example in a very low speed condition of a vehicle, the air fuel ratio cannot follow such variation and changes in a direction to enlarge the change in the number of revolutions and thus the revolution generating condition cannot be controlled. For more detailed explanation, reference is here made to FIGS. 1 and 2. In the characteristic diagram of FIG. 1, (a) represents the number of revolutions, Ne, (b) represents the pressure of an intake pipe, (c) represents the width of a driving pulse for an injector, and (d) represents the air fuel ratio. Usually, when the number of revolutions, Ne, changes, the pressure of the intake pipe changes somewhat later than that under the influence of the intake pipe volume. The quantity of air introduced into the internal combustion engine also lags behind the number of revolutions, Ne, in proportion to the intake pipe pressure. When correction is made according to the foregoing equation, the air quantity lags behind the intake pipe pressure and a pulse width signal for the injector also lags as shown in (e). At this time, when the number of revolutions, Ne, is high, the air fuel ratio changes to the rich side, while when the number of revolutions, Ne, is low, the air fuel ratio changes to the lean side, as shown in (g). Consequently, the characteristics of the internal combustion engine shown in FIG. 2 allow the variation in the number of revolutions to be promoted, resulting in that the driving condition becomes very unstable.

SUMMARY OF THE INVENTION

The present invention has been accomplished for solving the above-mentioned problems and it is the object thereof to provide a fuel control system for an internal combustion engine capable of controlling the air fuel ratio appropriately even during transition of variation in the quantity of intake air.

According to the present invention, in order to achieve the above object, there is provided a fuel controlling system for an internal combustion engine, which has an AN detecting means for detecting a detected output of an intake air quantity in a section of a predetermined crank angle, an AN calculating means for correcting the output of the AN detecting means, a revolution detecting means for detecting the number of revolutions of the internal combustion engine, and vehicle speed detecting means, and in which when the output of the revolution detecting means is below a predetermined value and that of the vehicle speed detecting means is within a predetermined range, this condition is defined as a very low speed mode and the constant in the correction processing is changed according to whether the vehicle is in the very low speed mode or not to thereby control the quantity of fuel to be fed to the engine.

DETAILED DESCRIPTION OF THE PREFERRED EMBODIMENT

An embodiment of the present invention will be described hereinunder with reference to the accompanying drawings.

Figure 3:
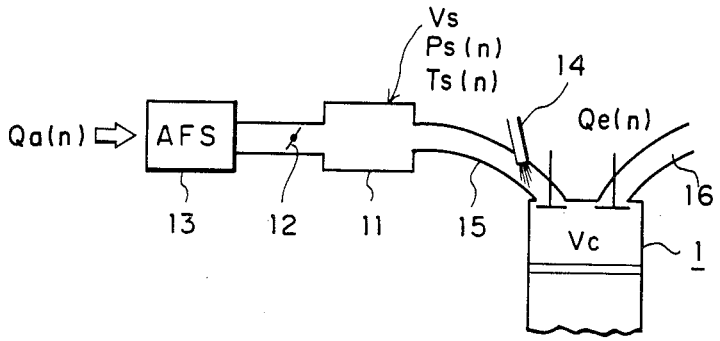
FIG. 3 is a schematic block diagram showing a model of an intake system in an internal combustion engine provided with a fuel controlling system according to the present invention.

Referring to FIG. 3, there is illustrated a model of an intake system in an internal combustion engine, in which the numeral 1 denotes an internal combustion engine having a volume of $V_c$ per stroke. Air is introduced into the engine 1 through an AFS 13 which is a Karman's vortex flow meter, a throttle valve 12, a surge tank 11 and an intake pipe 15, and fuel is fed to the engine 1 by means of an injector 14. The volume from the throttle valve 12 up to the internal combustion engine 1 is here assumed to be $V_s$. Numeral 16 denotes an exhaust pipe.

Figure 4:
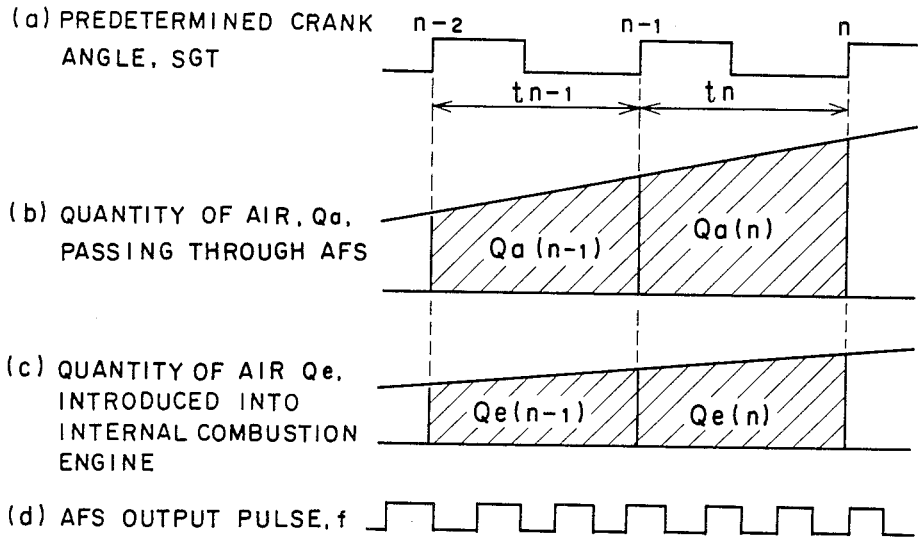
FIG. 4 is a characteristic diagram showing a relation of the intake air quantity to the crank angle in the intake system model of FIG. 3.

Referring now to FIG. 4, there is illustrated a relation of the intake air quantity to a predetermined crank angle in the internal combustion engine 1, in which (a) shows a predetermined crank angle (hereinafter referred to "SGT") in the engine 1, (b) shows the quantity of air, $Q_a$, passing through the AFS 13, (c) shows the quantity of air, $Q_e$, introduced into the engine 1, and (d) shows an output pulse, f, of the AFS 13. Further, the rising period of $n-2^{th}$ to $n-1^{th}$ time of the SGT is assumed to be $T_{n-1}$, the rising period of $n-1^{th}$ to $n^{th}$ time is $t_n$, the quantities of the intake air passing through the AFS 13 at periods $t_{n-1}$ and $t_n$ are assumed to be $Q_{a(n-1)}$ and $Q_{a(n)}$, respectively, and the quantities of air introduced into the engine 1 at periods $t_{-1}$ and $t_n$ are $Q_{e(n-1)}$ and $Q_{e(n)}$, respectively. Moreover, an average pressure in the surge tank 11 at the period $t_{n-1}$ and that at the period $t_n$ as well as average intake air temperatures at those periods are assumed to be $P_{s(n-1)}$, $P_{s(n)}$, $T_{s(n-1)}$ and $T_{s(n)}$, respectively. For example, $Q_{a(n-1)}$ corresponds to the number of output pulses of the AFS 13 at the period $t_{n-1}$. Since the rate of change in the intake temperature is small, if $T_{s(n-1)} \approx T_{s(n)}$ and the filling efficiency of the engine 1 is constant, $$P_{s(n-1)} \cdot V_c = Q_{e(n-1)} \cdot R \cdot T_{s(n)} \quad (1)$$

$$P_{s(n)} \cdot V_c = Q_{e(n)} \cdot R \cdot T_{s(n)} \quad (2)$$

wherein R is a constant. And if the quantity of air which stays in the surge tank 11 and intake pipe 15 at the period $t_n$ is $\Delta Q_{a(n)}$, $$\Delta Q_{a(n)} = Q_{a(n)} - Q_{e(n)} = V_s \cdot \frac{1}{R \cdot T_s} \times (P_{s(n)} - P_{s(n-1)}) \quad (3)$$

Then, from equations (1)-(3), $$Q_{e(n)} = \frac{1}{1 + \frac{V_c}{V_s}} \cdot Q_{e(n-1)} + \left(1 - \frac{1}{1 + \frac{V_c}{V_s}}\right) \cdot Q_{a(n)} \quad (4)$$

Therefore, the quantity of air $Q_{e(n)}$ introduced into the engine at period $t_n$ can be calculated from equation (4) on the basis of the quantity of air $Q_{a(n)}$ passing through the AFS 13. For example, if $V_c = 0.5$ l and $V_s = 2.5$ l, $$Q_{e(n)} = 0.83 \times Q_{e(n-1)} + 0.17 \times Q_{a(n)} \quad (5)$$

Figure 5:
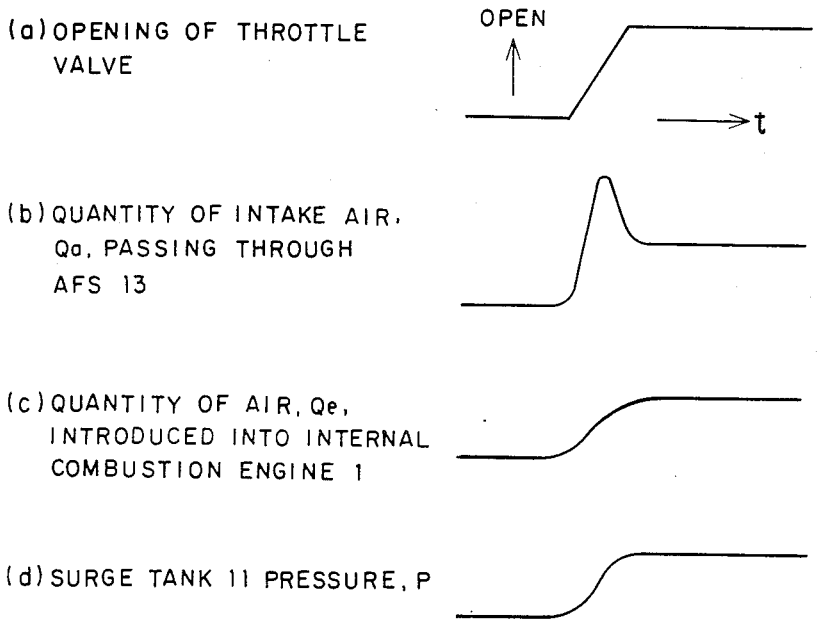
FIG. 5 is a waveform diagram showing changes in the quantity of intake air during passing through various portions of the internal combustion engine.

Referring now to FIG. 5, there is illustrated a condition with the throttle valve 12 opened, in which (a) shows the degree of opening of the throttle valve 12, (b) shows the quantity of intake air, $Q_a$, passing through the AFS 13, overshooting when the throttle valve 12 is open, (c) shows the quantity of air, $Q_e$, introduced into the internal combustion engine 1 after correction according to equation (4), and (d) shows the pressure, P, of the surge tank 11.

Figure 6:
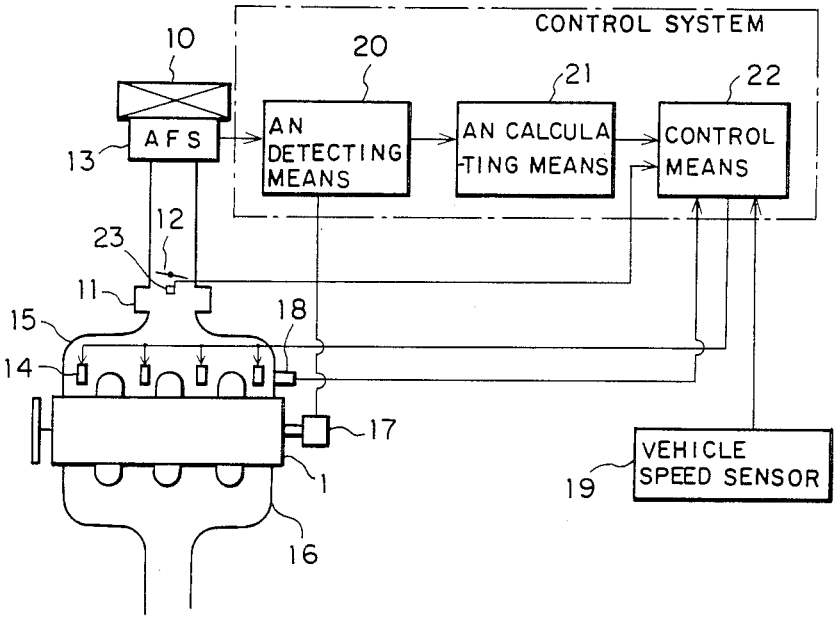
FIG. 6 is a block diagram showing a basic concept of the fuel controlling system for an internal combustion engine according to the present invention.

Referring to FIG. 6, there is illustrated a construction of the fuel controlling system for the internal combustion engine according to the present invention, in which the numeral 10 denotes an air cleaner disposed upstream of the AFS 13. The AFS 13 outputs such a pulse as shown in FIG. 4(*d*) according to the quantity of air introduced into the engine 1, while a crank angle sensor 17 outputs such a pulse as shown in FIG. 4(*a*) according to the rotation of the engine 1 (for example, the period from a pulse rising edge to the next rising edge is assumed to be 180° in terms of crank angle). Numeral 20 denotes an intake air quantity (simply "AN" hereinafter) detecting means for detecting the quantity of intake air in the period of a predetermined crank angle. The AN detecting means 20 calculates the number of output pulses of the AFS 13 on the basis of both the output of the AFS 13 and that of the crank angle sensor 17. Numeral 21 denotes an AN calculating means, which performs calculation similar to that of equation (5) in accordance with the output of AN detecting means 20 to determine the number of pulses corresponding to the output of the AFS 13, that is, corresponding to the quantity of air which will be introduced into the engine 1. Control means 22 controls the operating time of the injector 14 in accordance with the quantity of intake air to the engine 1 and on the basis of the output of a water temperature sensor 18 (e.g. thermistor) which detects the temperature of the cooling water for the engine 1, the output of an idle switch 23 which detects an idling condition and the output of a vehicle speed sensor 19 which detects the vehicle speed, thereby controlling the quantity of fuel to be fed to the engine 1.

Figure 7:
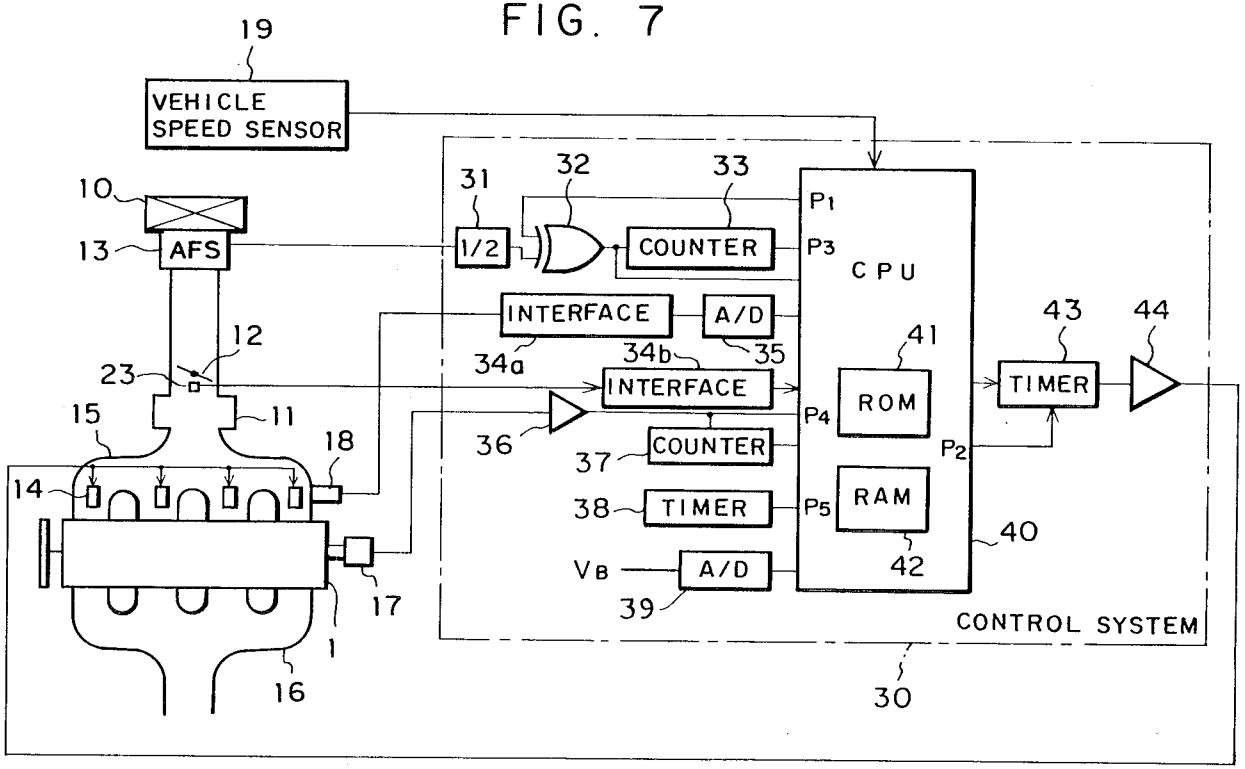
FIG. 7 is a block diagram showing an embodiment as a concrete example of the fuel controlling system of the invention.

FIG. 7 illustrates a more concrete construction according to an embodiment of the present invention. Numeral 30 denotes a control system which receives output signals from AFS 13, water temperature sensor 18, vehicle speed sensor 19 and crank angle sensor 17 to control the injector 14 which is provided for each cylinder of the engine 1. The control system 30 corresponds to the AN calculating means 21 and control means 22 in FIG. 6 and it is constituted by a central processing unit (simply "CPU" hereinafter) 40 such as, for example, a microcomputer having ROM 41 and RAM 42. Numeral 31 denotes a ½ divider which is connected to the output of the AFS 13, and numeral 32 denotes an exclusive OR gate (simply "EXOR" hereinafter), one input terminal of which is connected to the output of the ½ divider 31 and the other connected to an input terminal P1 of the CPU 40. The output terminal of the EXOR 32 is connected to both a counter 33 and an input terminal P3 of the CPU 40. The AN detecting means 20 is constituted by these components. Numeral 34*a* denotes an interface connected between the water temperature sensor 18 and an A/D converter 35; numeral 34b denotes an interface connected between the idle switch 23 and the CPU 40; and numeral 36 denotes a waveform shaping circuit which receives the output of the crank angle sensor 17 and the output of which is fed to both an interrupt input terminal P4 of the CPU 40 and a counter 37. Further, numeral 38 denotes a timer connected to an interrupt input terminal P5; numeral 39 denotes an A/D converter for converting the voltage of a battery (not shown) from analog to digital and providing the converted output to the CPU 40; and numeral 43 denotes a timer provided between the CPU 40 and a driver 44. The output of the driver 44 is connected to the injector 14 of each cylinder.

The operation of the fuel controlling system of the above construction will now be explained. The output of the AFS 13 is divided by the ½ divider 31 and then fed to the counter 33 through the EXOR 32 which is controlled by the CPU 40. The counter 33 measures the period between trailing edges of the output of the EXOR 32. The CPU 40 receives the trailing edge of the output of the EXOR 32 at its interrupt input terminal P3 and performs interrupt processing at every output pulse period of the AFS 13 or at every ½ period thereof to measure the period of the counter 33. The output of the water temperature sensor 18 is converted to voltage by the interface 34a, which voltage is then converted to a digital value at every predetermined time by means of the A/D converter 35. The digital value is received by the CPU 40. The output of the crank angle sensor 17 is fed through the waveform shaping circuit 36 to both the interrupt input terminal P4 of the CPU 40 and the counter 37. The output of the idle switch 23 is fed to the CPU 40 through the interface 34b. The CPU 40 performs interrupt processing at every rising of the output of the crank angle sensor 17 and detects the period between rising edges of the output of the crank angle sensor 17 from the output of the counter 37. The timer 38 provides an interrupt signal to the interrupt input terminal P5 of the CPU 40 at every predetermined time. The A/D converter 39 converts the voltage of a battery (not shown) from analog to digital and the CPU 40 receives the data of this battery voltage at every predetermined time. The timer 43 is preset for the CPU 40 and is triggered by the output port P2 of the CPU to produce a pulse of a predetermined width, which pulse output serves to drive the injectors 14 through the driver 44.

Figure 8:
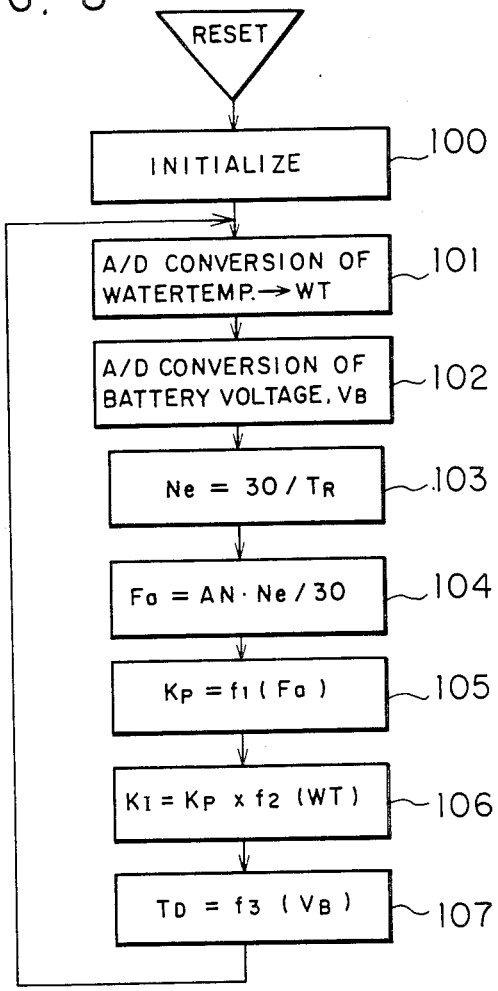
FIG. 8 is a flowchart showing operations thereof.
Figure 9:
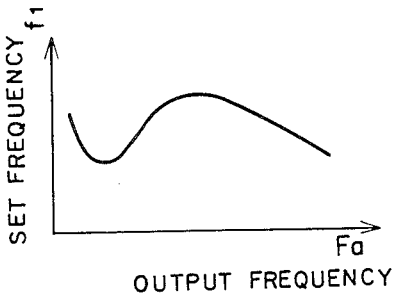
FIG. 9 is a correlation diagram showing a relation of a basic drive time transformation coefficient to the output frequency of an air flow sensor (AFS) in the embodiment of FIG. 7.

Now, the operation of the CPU 40 will be explained with reference to the flowcharts of FIGS. 8 and 10 to 12 as well as the characteristic diagram of FIG. 9. A main program of the CPU 40 is shown in FIG. 8, in which upon input of a reset signal to the CPU 40, the RAM 42 and input/output ports are initialized in step 100, then in step 101 the output of the water temperature sensor 18 is converted from analog to digital and the digital data thus obtained is stored as water temperature data WT in the RAM 42. Next, in step 102 the battery voltage is converted from analog to digital and the digital value thus obtained is stored as a battery voltage value VB in the RAM 42. In step 103, $30/T_R$ is calculated from the period $T_R$ of the crank angle sensor 17 to determine the number of engine rotations $N_e$. In step 104, there is made calculation of "$AN \cdot N_e/30$" on the basis of later-described load data AN and the number of engine rotations $N_e$ to determine the output frequency $F_a$ of the AFS 13. In step 105, a basic drive time transformation coefficient $K_p$ is calculated from the output frequency $F_a$ and $f_1$ which is set for $F_a$ as shown in FIG. 9. In step 106, the transformation coefficient $K_p$ is corrected by the water temperature WT and the corrected value is stored as a drive time transformation coefficient $K_I$ in the RAM 42. In step 107, there is made mapping of a data table $f_3$ which is prestored in ROM 41, using the battery voltage data $V_B$, to calculate a dead time $T_D$, which is stored in RAM 42. After the processing of step 107, the processing of step 101 is repeated.

Figure 10:
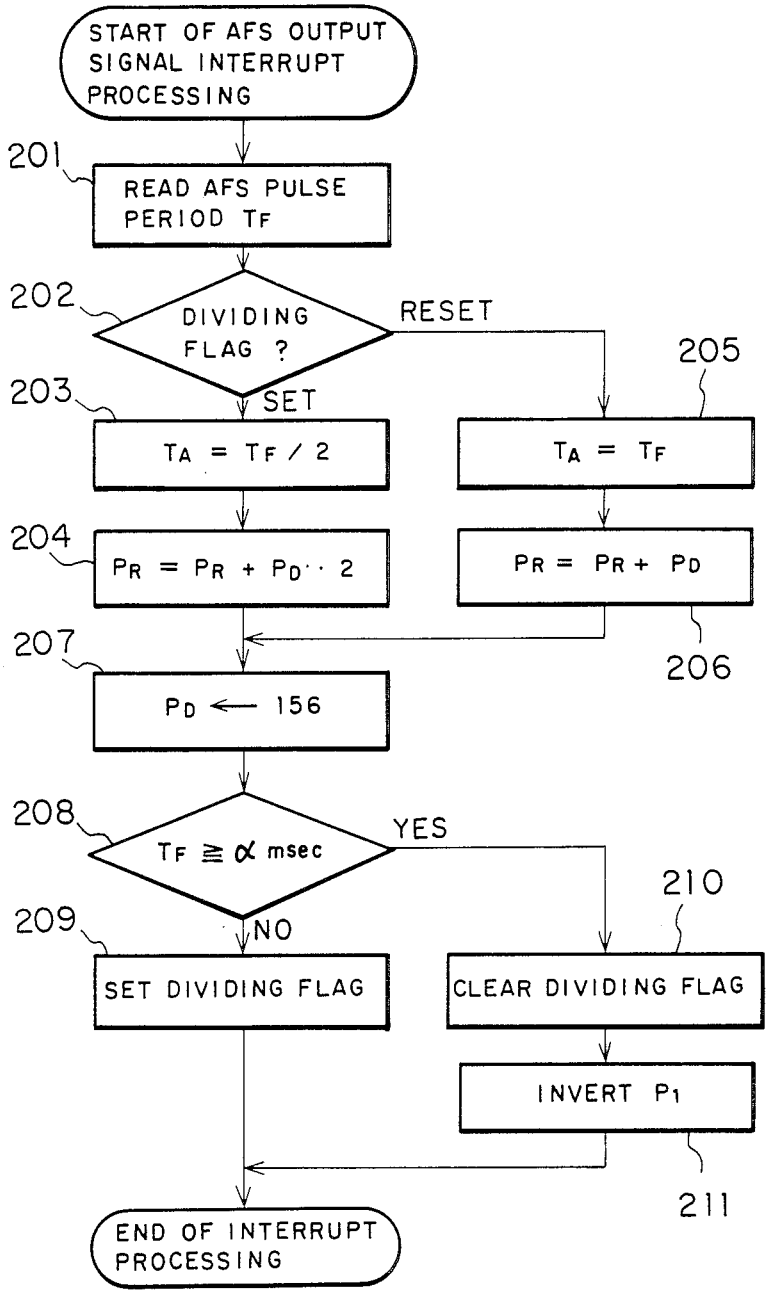
FIGS. 10 to 12 *a* and 12*b* are flowcharts explaining operations of the fuel controlling system in the embodiment of FIG. 7.

Referring now to FIG. 10, there is shown an interrupt processing for the interrupt input terminal P3, that is, for the output signal from the AFS 13. In step 201, an output $T_F$ of the counter 33 is detected to clear the counter, the $T_F$ representing the period between rising edges of the output of the gate 32. In step 202, judgment is made as to whether the dividing flag in the RAM 42 is set or not. If the answer is affirmative, then in step 203 the output $T_F$ is divided in two to obtain an output pulse period $T_A$ of the AFS 13, which is stored in the RAM 42. Then in step 204, a value obtained by multiplying the remaining pulse data $P_D$ by 2 is added to integrated pulse data $P_R$ and the result is used as a new integrated pulse data $P_R$. This integrated pulse data $P_R$ is of the number of pulses provided from the AFS 13 between rising edges of the crank angle sensor 17 and, for the convenience in handling, each pulse from the AFS 13 is multiplied by 156. On the other hand, if the dividing flag is reset in step 202, then in step 205 the period $T_F$ is stored as output pulse period $T_A$ in the RAM 42 and in step 206 the remaining pulse data $P_D$ is added to the integrated pulse data $P_R$. In step 207, 156 is set to the remaining pulse data $P_D$. In step 208, if $T_F > 2$ msec when the dividing flag is reset, or $T_F > 4$ msec when the dividing flag is set, execution passes to step 210, while in other cases execution passes to step 209. In step 209, the dividing flag is set, while in step 210, the dividing flag is cleared, then in step 211, the input Pl is inverted. Thus, in the processing of step 209, signal is fed to the interrupt input terminal P3 at a timing obtained y dividing in two the output pulse of the AFS 13, while in the case where the processing of step 210 is performed, signal is fed to the interrupt input terminal P3 at every output pulse of the AFS 13. After the processings of steps 209 and 211, the interrupt processing is completed.

Figure 11:
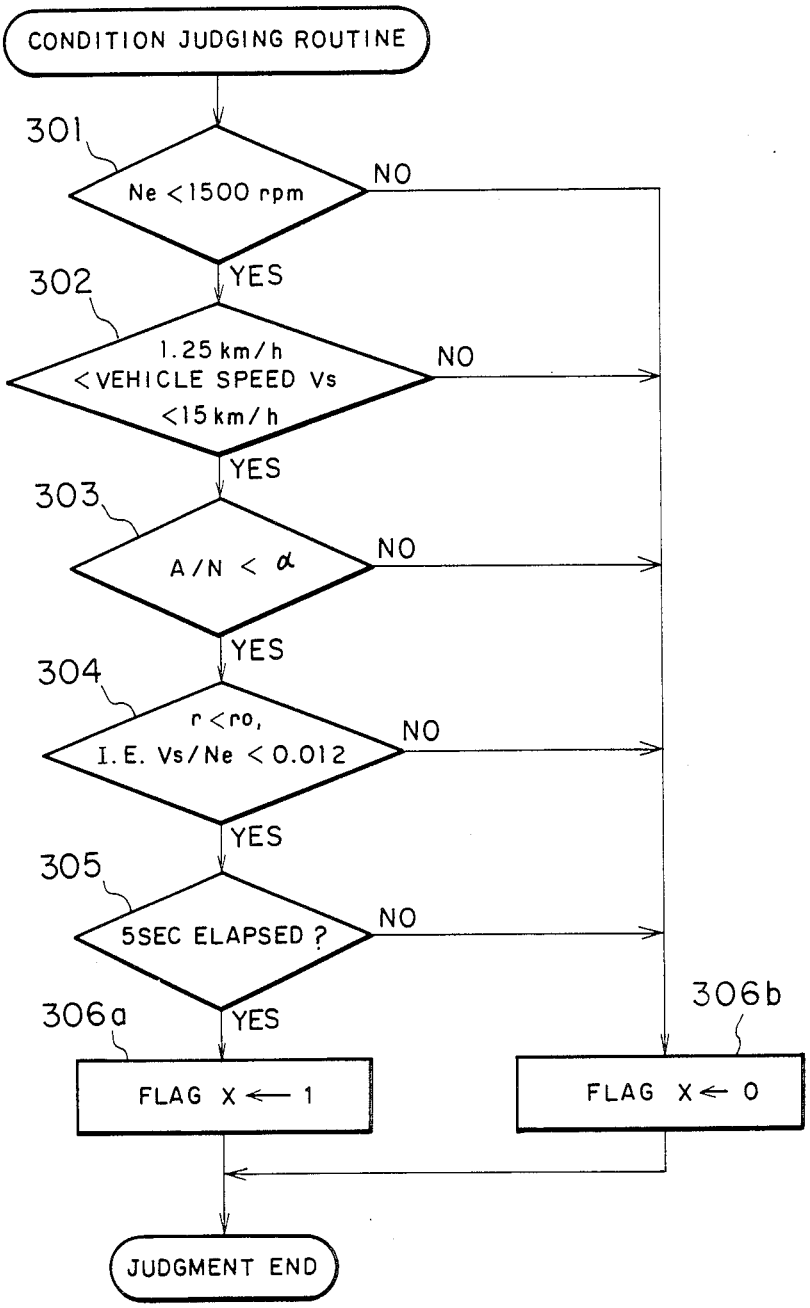

Referring now to FIG. 11, there is illustrated a very low speed mode judging processing. In step 301 there is made judgment as to whether the engine speed $N_e$ is below a predetermined value (1,500 rpm) or not; in step 302 there is made judgment as to whether the vehicle speed $V_s$ is below a predetermined value (15 km/h) and above a predetermined value (1.25 km/h), or not; in step 303 there is made judgment as to whether AN is below a predetermined value (3.79 pps) or not; and in step 304 there is obtained a ratio, r, of the vehicle speed $V_s$ to the engine speed $N_e$ ($r = V_s/N_e$) and judgment is made as to whether the ratio, r, is below a predetermined value, $r_0$, (0.012) or not. For example, the following judgments can be made on the basis of the ratio, r:

If $r_1 < r \leqq r_2$, 1st gear.

If $r_2 < r \leqq r_3$, 2nd gear.

If $r_3 < r \leqq r_4$, 3rd gear.

Where, $r_1$, $r_2$, $r_3$ and $r_4$ are constants determined by the transmission structure of the engine and effective tire diameter. In step 305 there is made judgment as to whether five seconds have elapsed or not after satisfying all the conditions of steps 301, 302, 303 and 304. When all the conditions of steps 301 to 305 are satisfied, it is judged that the running mode is the very low speed mode, and a flag X is made equal to 1, while if even one of the conditions of steps 301 to 305 is not satisfied, it is judged that the running mode is the very low speed mode, and the flag X is made equal to 0 in step 306*b*, to complete the processing.

Figure 12A:
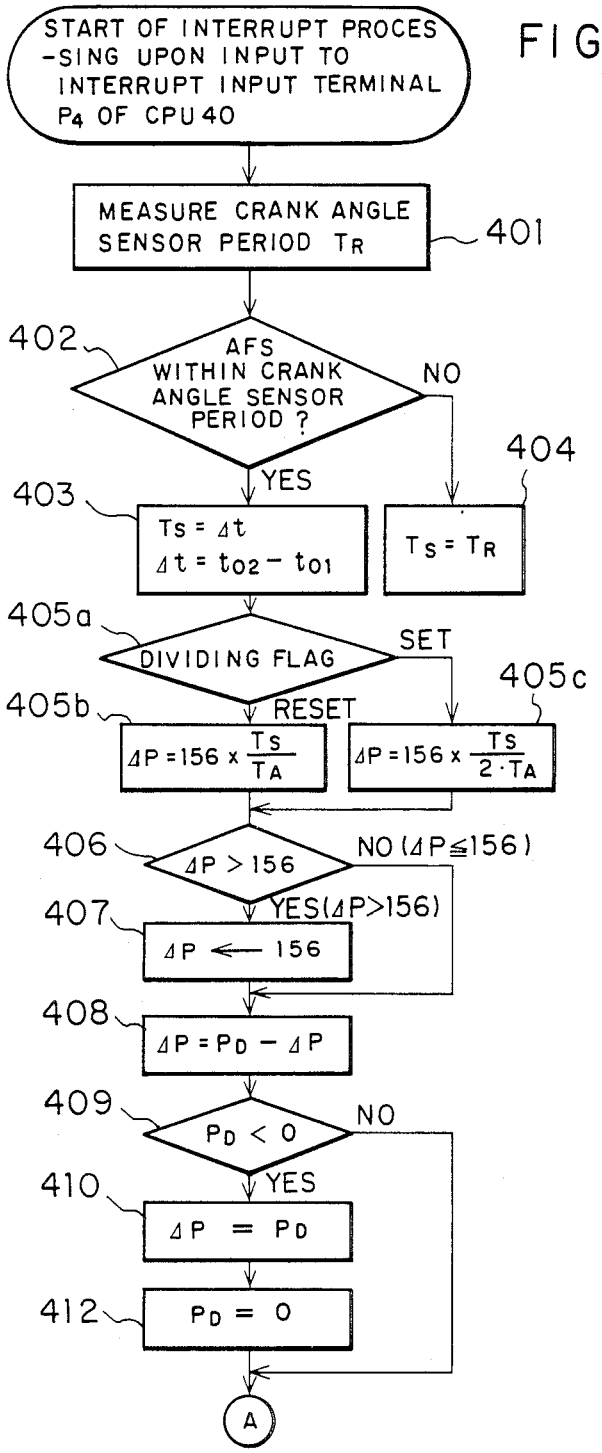
Figure 12B:
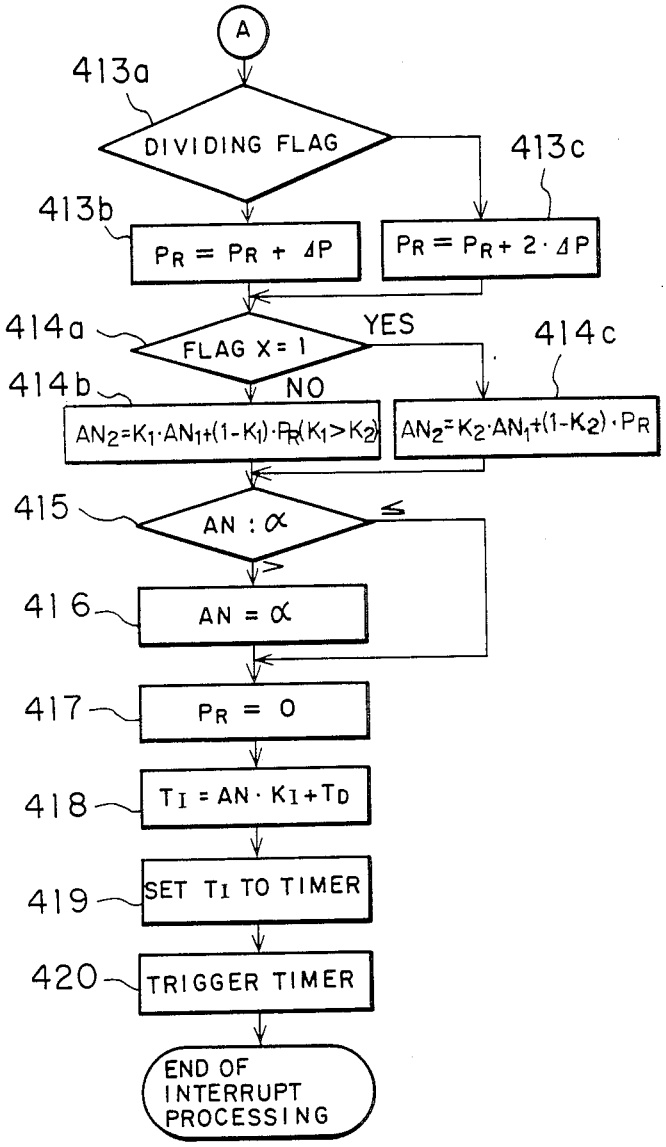

FIG. 12 shows an interrupt processing which is performed when an interrupt signal is developed at the interrupt input terminal P4 of CPU 40 upon outputting of the crank angle sensor 17. In step 401, the period between rising edges of the output of the crank angle sensor 17 is read from the counter 37 and stored as the period $T_R$ in the RAM 42, then the counter 37 is cleared. If in step 402 there is an output pulse of the AFS 13 within the period $T_R$, then in step 403 there is calculated a time difference $\Delta t = t_{02} - t_{01}$ between the time $t_{01}$ of the output pulse of the AFS 13 developed just therebefore and the interrupt time $t_{02}$ of this time of the crank angle sensor 17, and the result is designated a period $T_S$. On the other hand, when there is no output pulse of the AFS 13 within the period $T_R$, the period $T_R$ is used as the period $T_S$. In step 405*a*, judgment is made as to whether the dividing flag is set or not. If it is reset, then in step 405*b* the time difference $\Delta t$ is converted to the output pulse data $\Delta P$ by the calculation of $156 \times T_S/T_A$, while if it is set, then in step 405*c* the same conversion is made by the calculation of $156 \times T_S/2 \cdot T_A$. Thus, the pulse data $\Delta P$ is calculated on the assumption that the output pulse period of AFS 13 of last time and that of this time are the same. In step 406, whether the pulse data $\Delta P$ is larger than 156 or not is judged and if the answer is affirmative, $\Delta P$ is clipped to 156 in step 407, while if the answer is negative, execution passes to step 408. In step 408, the pulse data $\Delta P$ is subtracted from the residual pulse data $P_D$ and the result obtained is used as new residual pulse data $\Delta P$. In step 409, if the residual pulse data $P_D$ is positive, execution passes to step 413*a*, while if not so, since the calculated value of the pulse data $\Delta P$ is too large, the pulse data $\Delta P$ is made equal to the data $P_D$ in step 410 and the residual pulse data $P_D$ is made zero in step 412. In step 413*a*, judgment is made as to whether Dividing Flag is set or not. If the flag is reset, the pulse data $\Delta P$ is added to the integrated pulse data $P_R$ in step 413*b*, while if the flag is set, $2 \cdot \Delta P$ is added to $P_R$ in step 413*c* and the result is used as new integrated pulse data $P_R$. This data $P_R$ corresponds to the number of pulses which are presumed to have been output by the AFS 13 during the period between rising edges of the output of the crank angle sensor 17 of this time. In steps 414*a* to 414*c*, there is made calculation corresponding to equation (5). More particularly, if it is judged in step 414*a* that the running condition is a very low speed condition, there is made calculation of $AN_2 = K_2 AN_1 + (1 - K_2) \cdot P_R$, using this-time load data $AN_2$ and last-time load data $AN_1$ calculated up to the previous rising edge of the output of the crank angle sensor 17, as quantities of intake air at the predetermined crank angle, as well as the integrated pulse data $P_R$ On the other hand, if it is judged in step 414*a* that the running condition is other than the very low speed condition, there is made calculation of $AN_2 = -K_1 AN_1 + (1 - K_1) \cdot P_R (K_1 > K_2)$ in step 414*b* and the result is used as new such load data AN of this time. In step 415, if the load data AN is larger than a predetermined value $\alpha$, it is clipped to $\alpha$ in step 416 to prevent the load data AN from becoming too large as compared with actual value even in the maximum operating condition of the engine. Then, in step 417, the integrated pulse data $P_R$ is cleared. In step 418, there is made calculation of a drive time data $T_1 = AN \cdot K_1 + T_D$ using the load data AN, drive time transformation coefficient $K_1$ and dead time $T_D$. In step 419, the drive time data $T_1$ is set to the timer 43, and in step 420, the timer 43 is triggered, whereby the four injectors 14 are driven at a time according to the data $T_1$ to complete the interrupt processing.

Figure 13:
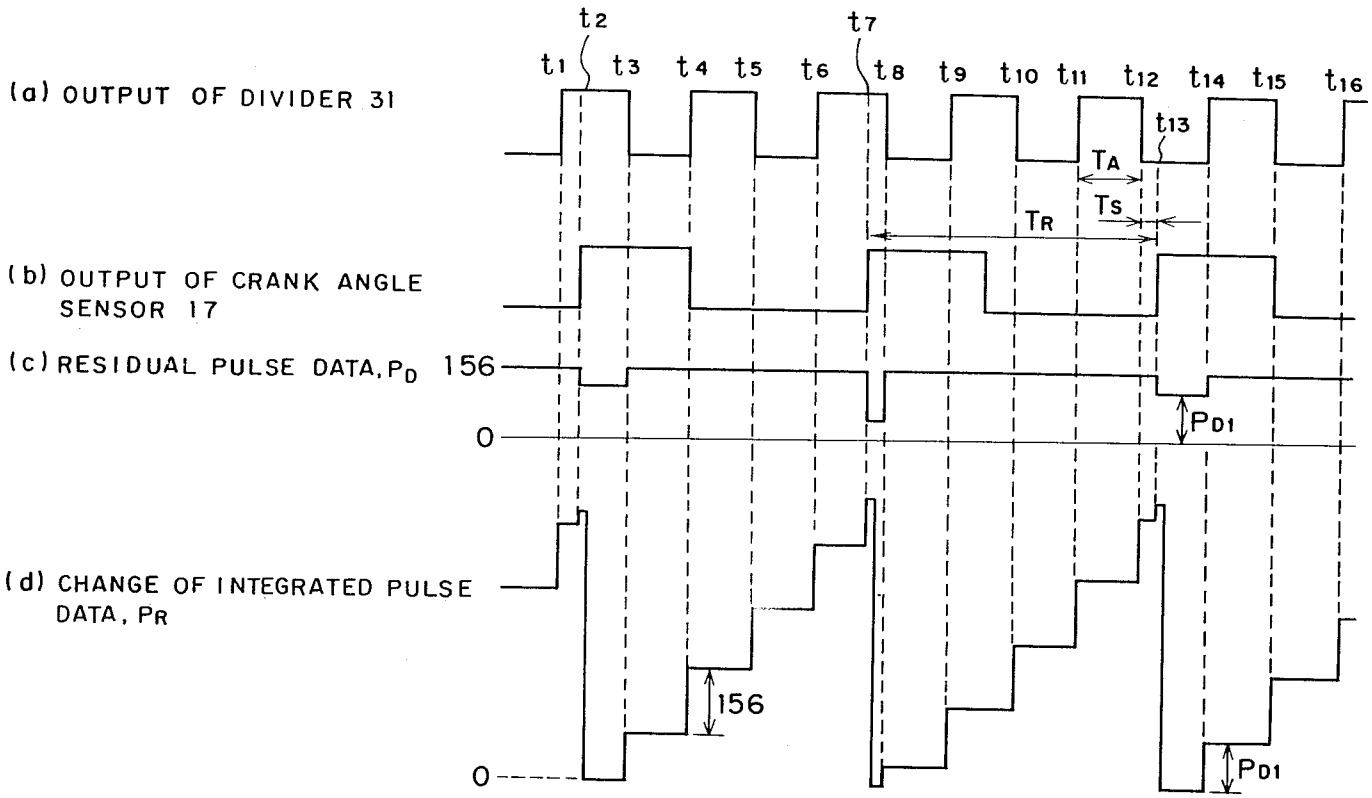
FIG. 13 is a timing chart showing timing of each flow in the flowcharts of FIGS. 10 and 12.

FIG. 13 show timings at the time of clear of the dividing flag in the processings of FIGS. 8, 10 and 11. In FIG. 13, (a) shows the output of the divider 31; (b) shows the output of the crank angle sensor 17; (c) shows the residual pulse data $P_D$, each pulse is set to 156 at every rising and trailing edge of the output of the divider 31 (rising edge of the output pulse of the AFS (3) and is changed into, for example, the result of calculation $P_D = P_D - 156 \times T_S/T_A$ at every rising edge of the output of the crank angle sensor 17 (this corresponds to the processings of steps 405 to 412); and (d) shows changes of the integrated pulse data $P_R$, showing in what manner the residual pulse data $P_D$ are integrated at every rising or trailing edge of the output of the divider 31.

Figure 1:
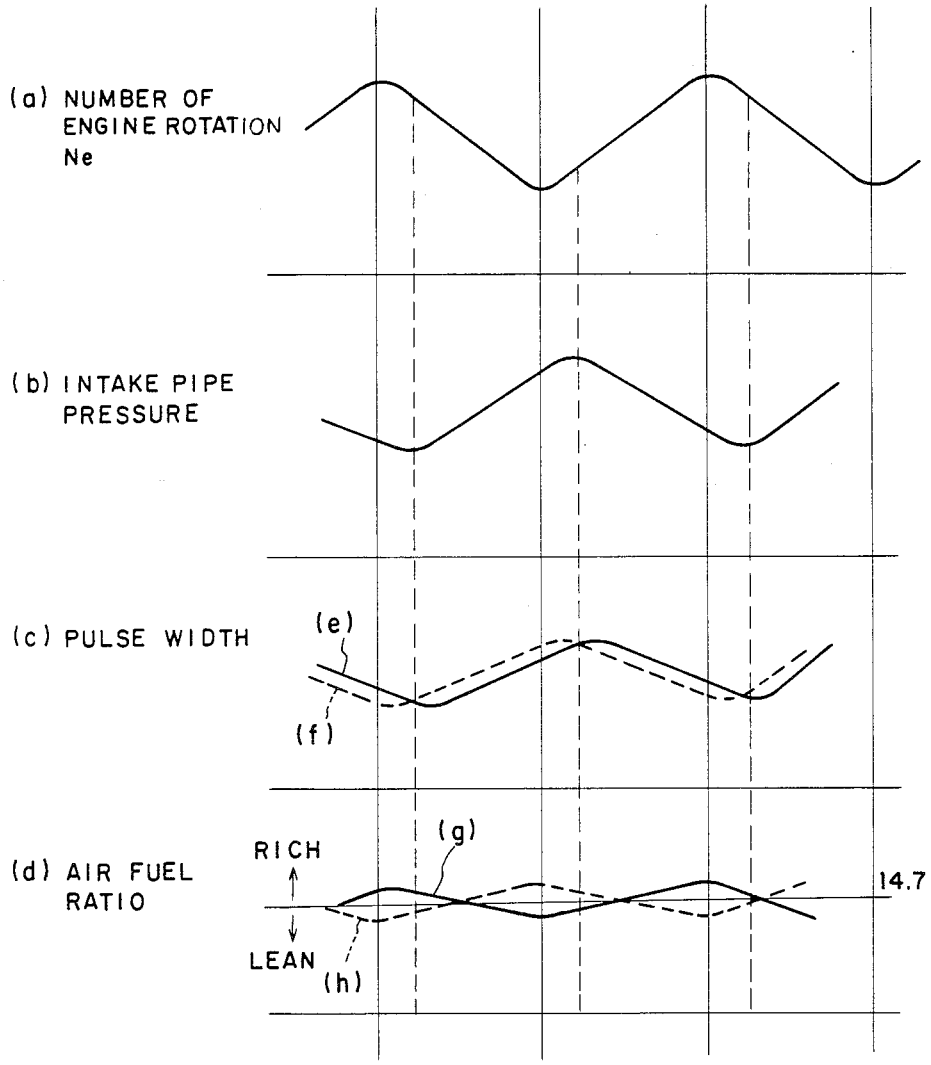
FIGS. 1(*a*) to (*d*) are operation waveform diagrams of a fuel controlling system for an internal combustion engine, FIGS. 1(*c*) and (*d*) showing pulse width and air fuel ratio, respectively, in a conventional system in terms of solid line waveforms (e) and (g) and show pulse width and air fuel ratio in the present invention in terms of dotted line waveforms (f) and (h), for convenience' sake.
Figure 2:
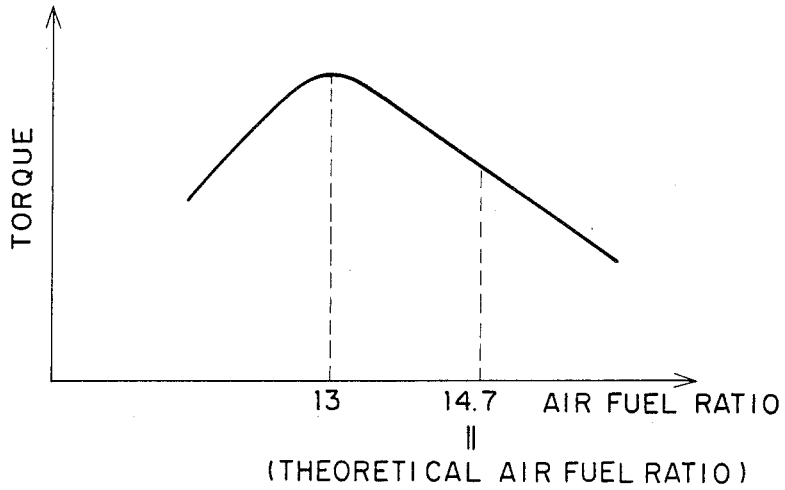
FIG. 2 (PRIOR ART)
FIG. 2 is a characteristic diagram of an internal combustion engine using a conventional fuel controlling system.

Thus, in the above embodiment, the value of the filter constant K as a correction coefficient in the correction equation for the intake air quantity in the internal combustion engine is set at $K_1$ when the running condition is not a very low speed condition and it is changed to a smaller value $K_2$ when the running condition is a very low speed condition, whereby the delay of intake can be made small and the phase can be set on the leading side. Consequently, the pulse width signal is also on the leading side as in (f) shown in FIG. 1(*c*) which has been explained in connection with the prior art and the air fuel ratio can be set to the lean side when $N_e$ is high and to the rich side when $N_e$ is low, as indicated at (h) of FIG. 1(*d*). Thus, it is possible to attain a stable engine speed without promotion of the change in the number of revolutions or the engine speed.

Although in the above embodiment, the number of output pulses of the AFS 13 between rising edges of the output of the crank angle sensor 17 was counted, it may be between trailing edges of the above-mentioned output, or there may be counted the number of output pulses of the AFS 13 over several periods of the crank angle sensor 17. Moreover, although the number of output pulses of the AFS 13 was counted in the above embodiment, the number of output pulses may be multiplied by a coefficient which corresponds to the output frequency of the AFS 13. Further, for crank angle detection, there may be used an ignition signal of the engine 1 in place of the crank angle sensor 17. Also in this case there will be attained the same effect.

Moreover, although in the above embodiment the crank angle AN as load data was used in judging the load condition during detection of a very low speed running condition, the judgment may be made on the basis of ON-OFF of the idle switch 23 or the degree of opening of the throttle valve. Further, although in the above embodiment the coefficient K was made constant during detection of a very low speed running condition, the coefficient K may be further corrected using engine rotating speed, load and gear ratio.

According to the present invention, as set forth hereinabove, the quantity of intake air in the internal combustion engine is corrected on the basis of a correction equation and the coefficient in the correction equation is changed in a very low speed running condition. Consequently, the air fuel ratio is controlled to an appropriate value even in a transition stage of the change of the intake air quantity, thus permitting stable driving with less change in revolution even in a very low speed condition.

What is claimed is:

1. In a fuel controlling system attached to an internal combustion engine to control the quantity of fuel to be fed to the engine, having an intake air quantity sensor provided in an intake pipe of the engine to detect an actual quantity of intake air flowing through the intake pipe, a crank angle sensor disposed in the vicinity of a crank shaft as an output shaft of the engine to detect a crank angle which is an angle of rotation from a dead center of the crank shaft, and a vehicle speed sensor for detecting the running speed of a vehicle on which is mounted the internal combustion engine, the improvement characterized by including:

a predetermined intake air quantity detecting means for detecting the quantity of intake air at a predetermined crank angle on the basis of both the quantity of intake air detected by said intake air quantity sensor and the crank angle detected by said crank angle sensor;

a predetermined intake air quantity correcting means for correcting the output of said predetermined intake air quantity detecting means by performing an arithmetic processing using a predetermined certain correction coefficient;

a revolution detecting means for detecting the number of revolutions, or the output, of the internal combustion engine on the basis of said detected crank angle; and a correction coefficient changing means which judges that the running condition of the vehicle is a very low speed condition when the number of revolutions of the internal combustion engine detected by said revolution detecting means is below a predetermined value and when the vehicle running speed detected by said vehicle speed sensor is within a predetermined range, and which changes said correction coefficient used in said predetermined intake air quantity correcting means when the vehicle and the internal combustion engine are in said very low speed condition, thereby controlling the quantity of fuel to be fed to the engine in said very low speed running condition.

2. A fuel controlling system for an internal combustion engine according to claim 1, wherein said correction coefficient changing means makes control to change a filter constant K as said correction coefficient used in said predetermined intake air quantity correcting means when the vehicle and the internal combustion engine are in said very low speed condition, and wherein said predetermined intake air quantity correcting means performs a correction processing using the following arithmetic expression:

$$Q_{e(n)}=K\cdot Q_{e(n-1)}+(1-K)\cdot Q_a$$

where, $Q_a$ the result of detection by said predetermined intake air quantity detecting means $Q_{e(n-1)}$: quantity of intake air of $(n-1)^{th}$ time at the predetermined crank angle in the internal combustion engine $Q_{e(n)}$: quantity of intake air of $(n)^{th}$ time at the predetermined crank angle in the engine K: filter constant as said certain correction coefficient 3. A fuel controlling system for an internal combustion engine according to claim 1, wherein said correction coefficient changing means changes the filter constant K as said correction coefficient used in said predetermined intake air quantity correcting means to a specific value $K_1$ when the vehicle and the internal combustion engine are not in said very low speed condition, and it changes said filter constant K to a specific value $K_2$ which is smaller than the value Kl when the vehicle and the engine are in said very low speed condition.

4. A fuel controlling system for an internal combustion engine according to claim 1, wherein said predetermined intake air quantity correcting means performs a correction processing using the following arithmetic expression:

$$Q_{e(n)}=K\cdot Q_{e(n-1)}+(1-K)\cdot Q_a$$

where, $Q_a$: the result of detection by said predetermined intake air quantity detecting means $Q_{e(n-1)}$: quantity of intake air of $(n-1)^{th}$ time at the predetermined crank angle in the internal combustion engine $Q_{e(n)}$: quantity of intake air of $(n)^{th}$ time at the predetermined crank angle in the engine K: filter constant as said certain correction coefficient and wherein said correction coefficient changing means changes the filter constant K to a specific value $K_1$ when the vehicle and the internal combustion engine are not in said very low speed condition, and it changes the filter constant K to a specific value $K_2$ which is smaller than the value $K_1$ when the vehicle and the engine are in said very low speed condition.

5. A fuel controlling system for an internal combustion engine according to claim 1, wherein said predetermined intake air quantity correcting means and said correction coefficient changing means are constituted by a central processing unit (CPU) having a read only memory (ROM) and a random access memory (RAM); wherein said predetermined intake air quantity detecting means is composed of a ½ divider which receives the detected output of said intake air quantity sensor and divides it in half, an exclusive OR gate which performs an exclusive OR operation for both the divided output of said ½ divider and an output based on crank angle provided from said CPU, and a counter for counting the period between trailing edges of the output of said exclusive OR gate; and wherein said revolution detecting means is composed of a waveform shaping circuit for shaping the waveform of the detected output of said crank angle sensor and a counter which receives the output of said waveform shaping circuit and counts the period between rising edges of the detected output of said crank angle sensor.

6. A fuel controlling system for an internal combustion engine according to claim 1, wherein said predetermined intake air quantity correcting means and said correction coefficient changing means are constituted by a central processing unit (CPU) having a read only memory (ROM) and a random access memory (RAM); wherein said predetermined intake air quantity detecting means is composed of a ½ divider for dividing the detected output of said intake air quantity sensor in half, an exclusive OR circuit which performs an exclusive OR operation for both the divided output of said ½ divider and an output based on crank angle provided from said CPU, and a counter for counting the period between rising edges of the output of said exclusive OR circuit; wherein said revolution detecting means is composed of a waveform shaping circuit for shaping the waveform of the detected output of said crank angle sensor and a counter for counting the output of said waveform shaping circuit at the period between rising edges of the detected output of said crank angle sensor; wherein a coefficient changing section as said correction coefficient changing means in said CPU compares an interrupt input from said waveform shaping circuit with a predetermined number of crank shaft revolutions stored in said ROM, judges that the vehicle and the internal combustion engine are in the very low speed condition when the engine speed is below said predetermined number of revolutions and the vehicle speed detected by said vehicle speed sensor is within the predetermined range, and changes said certain correction coefficient to a filter constant $K_2$ which is a correction coefficient in the very low speed condition; and wherein a correction section as said intake air quantity correcting means in said CPU calculates this-time load data $AN_2$ as intake air quantity at the predetermined crank angle according to the following equation on the basis of the last-time load data $AN_l$ as intake air quantity at the predetermined crank angle, said filter constant $K_2$ and integrated pulse data $P_R$ of the output of said divider as the result of detection by said predetermined intake air quantity detecting means:

$$AN_2 = K_2 AN_1 + (1 - K_2) \cdot P_R$$

and controls the quantity of fuel to be fed to the internal combustion engine on the basis of said load data $AN_2$.

* * * * *

UNITED STATES PATENT AND TRADEMARK OFFICE

CERTIFICATE OF CORRECTION

PATENT NO. : 4,809,664 Page 1 of 2

DATED : March 7, 1989

INVENTOR(S) : KATSUYA NAKAMOTO ET AL.

It is certified that error appears in the above-identified patent and that said Letters Patent is hereby corrected as shown below:

Front Page, Col. 2, [57], line 7, "engine." should be --engine, the fuel controlling system having an intake air quantity sensor for detecting the intake air quantity, a crank angle sensor for detecting a crank angle of the engine, an intake air quantity detecting unit for detecting the quantity of intake air in the period of a predetermined crank angle on the basis of both the output of the intake air quantity sensor and that of the crank angle sensor, an intake air quantity calculating unit for correcting the detected intake air quantity, a revolution detecting unit for detecting the number of revolutions of the engine on the basis of the output of the crank angle sensor, a vehicle speed detecting unit for detecting the running speed of a vehicle on which the engine is mounted, and a correction coefficient controlling unit which judges whether the vehicle is in a very low speed running condition or not on the basis of both the output of the revolution detecting unit and that of the vehicle speed detecting unit and which makes control to change a correction coefficient in the intake air quantity calculating unit when the vehicle is in the very low speed running condition, thereby preventing unstable variations in the engine speed even when the vehicle is in the very low speed running condition.--

Col. 3, line 49, "≈" should be --≒--.

UNITED STATES PATENT AND TRADEMARK OFFICE

CERTIFICATE OF CORRECTION

PATENT NO. : 4,809,664

DATED : March 7, 1989

INVENTOR(S) : KATSUYA NAKAMOTO ET AL.

It is certified that error appears in the above-identified patent and that said Letters Patent is hereby corrected as shown below:

Col. 4, line 4, "l" (both occurrences) should be --ℓ--.

Col. 6, line 40, "y" should be --by--;
Col. 6, line 54, after "value" insert --α--;

Col. 8, line 15, "AFS(3)" should be --AFS 13)--.

Col. 9, line 64, after "$Q_a$" insert --:--.

Col. 12, line 15, after "=$K_2$" insert --.--.

Signed and Sealed this

Thirtieth Day of October, 1990

*Attest:*

HARRY F. MANBECK, JR.

*Attesting Officer*

*Commissioner of Patents and Trademarks*